United States Patent [19]

Amos et al.

[11] Patent Number: 4,736,591

[45] Date of Patent: Apr. 12, 1988

[54] CRYOPUMPS

[75] Inventors: Richard D. Amos, Surrey; Basil D. Power; Francis C. Robson, both of Crawley, all of England

[73] Assignee: The BOC Group plc, Windlesham, England

[21] Appl. No.: 920,325

[22] Filed: Oct. 17, 1986

[30] Foreign Application Priority Data

Oct. 23, 1985 [GB] United Kingdom ..... 8526191

[51] Int. Cl.[4] ..... B01D 8/00

[52] U.S. Cl. ..... 62/55.5; 417/901

[58] Field of Search ..... 62/55.5; 417/901

[56] References Cited

U.S. PATENT DOCUMENTS 4,531,372 7/1985 Slabaugh ..... 62/55.5

4,611,467 9/1986 Peterson ..... 62/55.5

FOREIGN PATENT DOCUMENTS 0102787 8/1984 European Pat. Off. .

*Primary Examiner*—William E. Wayner

*Attorney, Agent, or Firm*—David A. Draegert; Larry R. Cassett

[57] ABSTRACT

A cryogenerator pumping system comprises at least two cryopanels, maintained within an enclosure having an open end which is adapted for attachment to the chamber to be pumped and which embodies a throttling device effective to restrict the flow of gas from the chamber to the cryogenerator pump, a relatively higher temperature cryopanel within the enclosure being arranged to project beyond the plane of the throttling device whereby to be capable of condensing water and other volatile vapors produced in the chamber and thereby prevent the deposition of such vapors upon the throttling device.

14 Claims, 1 Drawing Sheet

CRYOPUMPS

This invention relates to cryogenerator pumping systems and is particularly though not exclusively directed to such cryogenerator pumping systems adapted to produce high vacuum in ion sputtering and like equipment. The invention is particularly concerned with such pumping systems embodying at least two stages of cooling respectively at cryopanels effective to operate at relatively higher and lower temperatures.

Cryogenerator pumps are now well established for the production of a high vacuum in a sealed chamber. Such cryogenerators operate by the controlled reduction of pressure of gas generally supplied by a suitable pump provided independently of and physically separated from the cryogenerator body. The gas pump is included in a closed gas circuit with the cryogenerator and is arranged to supply gas, generally helium, to the generator at ambient temperature and at a pressure of typically 20 bar.

The pressure of gas supplied to the cryogenerator is internally reduced in controlled manner, by two stages of expansion respectively within the swept volume of two pistons moving within co-operating cylinders connected in series. Expansion is controlled by indirectly damping the stroke of the cylinders by way of restrictive orifices introduced into gas conduits within the cryogenerator and by gas reservoirs effective to accumulate gas pressure during a part of each gas reduction cycle.

A cryopanel in heat exchange relationship with each gas reduction stage is provided externally on the cryogenerator body and is cooled by the controlled reduction of gas pressure. Typically the cryopanel associated with the first higher pressure reduction stage will operate at a temperature of about 40°–100° K. with the cryopanel associated with the second lower pressure reduction stage operating at a temperature of about 10° K.

The cryopanels are effective as a pump to reduce gas pressure in a chamber by providing condensation of gas in the chamber on the cooled cryopanel surfaces. In general water and contaminants such as volatile hydrocarbons will be condensed upon the higher temperature panel with condensable gases such as nitrogen oxygen and argon being condensed upon and collected on the lower temperature panel.

Figure 1:
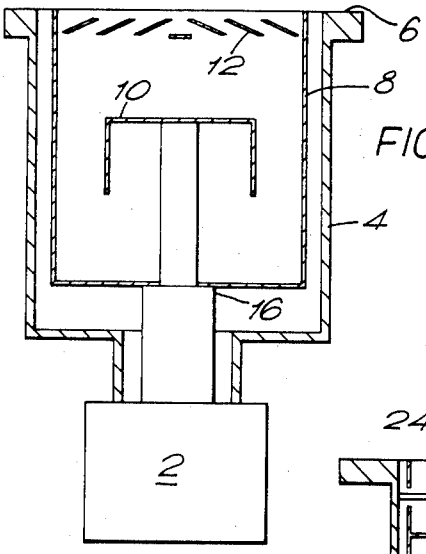

In a typical pumping arrangement such as illustrated in FIG. 1 of the accompanying drawings, cryopanels secured to the body of a cryogenerator are disposed within an enclosure which is sealed at one end to the cryogenerator body and which has an opening at the other end adapted to interface with the chamber to be pumped. A suitable valved inlet at the cryogenerator end of the enclosure permits the connection of a mechanical or other pump for low pressure roughing.

The configuration of cryopanels in the arrangement of FIG. 1 produces condensation of water vapour and volatile contaminants together with for example, carbon dioxide on the radially outer high temperature panel which operates typically at a temperature within the range 40°–100° K. Nitrogen, oxygen, argon and other condensable gases are condensed upon and retained on the outside of the lower temperature panel which is nested within the outer panel and which operates typically at a temperature of about 15° K.

In addition, non condensable gases such as hydrogen, helium and neon characterised by a vapour pressure of about 1 torr at 15° K., cannot be so condensed and must be adsorbed on to a layer of charcoal suitably bonded to the inner surface of the low tenperature panel.

During ion sputtering and the like within a chamber which has been evacuated by a cryogenerator pump, significant quantities of water vapour together with gas and other molecules are produced. In general such quantities of water vapour, gas and other molecules will, in addition to overloading the cryopump, produce an unacceptable rate of condensation and adsorption upon the cryogenerator panels and will further reduce pumping capacity and efficiency.

It has been previously proposed, in order to overcome these disadvantages, to operate a cryogenerator pumping system for ion sputtering and the like, by introducing a throttling device between the cryopump and the chamber being pumped and to carry out the ion sputtering with the device either fully of preferably partly throttled. In this way, the pumping speed during sputtering is reduced thereby avoiding overloading the pump and reducing the rate of condensation and adsorption upon the pump cryopanels, while maintaining an acceptably low pressure within the pumped sputtering chamber.

However, films produced upon substrates in high vacuum are known to be highly sensitive to the presence of water vapour which is produced in substantial quantities during ion sputtering and the existence of such water vapour particularly when this is not removed by the cryopump can seriously and unacceptably degrade the quality of such films.

It has been proposed to overcome this difficulty and to reduce the effects of water vapour in the production of vacuum deposited films, by cooling the throttling device, usually by heat exchange with the cryopump, in order to produce condensation of the vapour upon the device particularly when it is fully throttled and is exposing a relatively large surface area. Such a cooled throttling device arrangement however produces a deposit upon the relatively movable components on the throttling device and can significantly impair its operation as well as reducing its conductance to gas flow.

It is accordingly the object of the present invention to produce a cryogenic pumping system that tends to reduce these difficulties.

The present invention, according to its broadest aspects, provides a cryogenerator pumping system comprising at least two cryopanels maintained within an enclosure having an open end which is adapted for attachment to the chamber to be pumped and which embodies a throttling device effective to restrict the flow of gas from the chamber to the cryogenerator pump, a relatively higher temperature cryopanel within the enclosure being arranged to project beyond the plane of the throttling device whereby to be capable of condensing water and other volatile vapours produced in the chamber and thereby prevent the deposition of such vapours upon the throttling device.

Ideally that portion of the higher temperature cryopanel which projects beyond the throttling device selectively and predominantly condenses water or other volatile vapours.

In a preferred embodiment of the invention, the throttling device comprises a plurality of spaced elongate rectangular vanes extending in parallel across the opening of the chamber being pumped and the cryogenerator pump enclosure. The vanes are arranged to rotate between a first position with the vanes interlinked in a common plane to produce throttling and a second position with the vanes spaced in parallel planes to produce a high flow conductance. The vanes may be rotated to an intermediate position to produce any selected degree of throttling required.

Suitably the throttling device is thermally insulated from the cryopanels to ensure that it operates at a temperature above that of the extended higher temperature cryopanel and inhibits the selective deposition of water vapour. Conveniently the throttling device is arranged to operate substantially at ambient temperature by being secured to the cryopump enclosure by way of support means of high thermal conducivity which conducts heat to the device to compensate for heat lost to the cryopanels.

Figure 2:
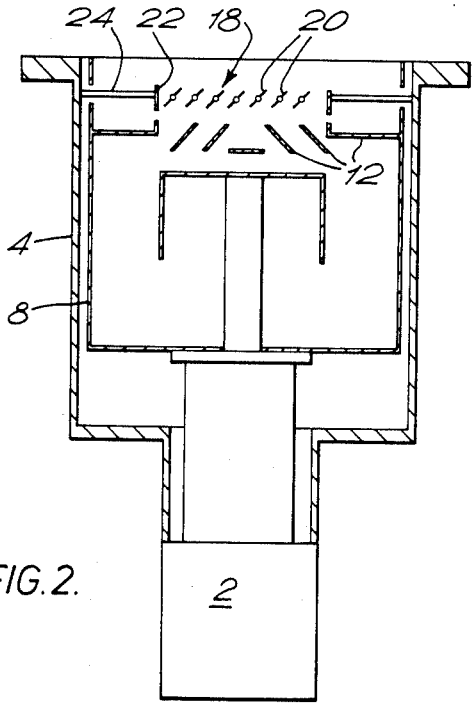

An embodiment of the invention will now be particularly described by way of example with reference to the accompanying drawings in which FIG. 1 is a sectional side view of a known cryogenic pumping system including cryopanels for pumping a chamber adapted for ion sputtering and FIG. 2 is a sectional side view of a cryogenic pumping system according to the present invention and including a throttling device adjacent and extended cryopanel for selectively reducing the condensation of water and other vapour upon the device.

Referring firstly again to FIG. 1, this illustrates a conventional cryogenerator adapted to produce a low pressure in a chamber, for example a chamber including ion sputtering equipment or the like.

The cryogenerator comprises a body portion 2 having inlets and outlets respectively for receiving and for discharging high pressure helium from a separate compressor (not shown), provided independently of the cryogenerator.

Secured to the body 2 in an enclosure 4 which forms part of the pump envelope and which has an upper flanged end 6 adapted to be sealingly secured, for example by way of O rings, to the chamber being pumped.

Disposed within the enclosure 4 and secured in heat exchange relationship to the high temperature stage of the cryogenerator is a higher temperature cryopanel 8 in the form of a cylinder having an open end adjacent the flanged opening provided in enclosure 4. Nested within the high temperature panel and in heat exchange relationship with the low temperature stage of the cryogenerator is a low temperature cryopanel 10 which communicates through one path with the chamber to be pumped by way of throttling louvres 12 provided at the open end of cryopanel 8.

Provided also in the enclosure 4 and adjacent the cryogenerator body 2 is an opening (not shown) enabling the space within the enclosure to be connected to a mechanical or other pump for roughing the vacuum system.

In use of the cryogenerator, the cryopanel 8 will operate at a temperature 40°-100° K. and will be effective to condense water vapour together with volatile hydrocarbon and like condensable contaminants together with carbon dioxide if present. Cryopanel 10 will operate at a temperature of about 12° K. and will be effective to condense nitrogen and oxygen together with other condensable gases on the radially outside surface. Cryopanel 10 will also adsorb non-condensable gases on a charcoal layer provided on its radially inner surface to produce within the pumping chambers pressure of the order of $10^{-8}$, torr with louvres 12 open.

Referring now to FIG. 2 of the drawings in which like parts have like numerals, a variable throttling device indicated generally at 18 is interposed between the fixed low tenperature louvres 12 adjacent to the opening enclosure 4 and the chamber to be pumped. As previously described the chamber to be pumped is arranged to abut and to be secured to the flange at the open end of enclosure 4.

The throttling device 18 is effective to increase the gas flow impedence between the chamber and the cryopanels 8 and 10 of the cryopump and thereby reduce the load on the pump during ion sputtering or the like occurring within the chamber.

In this embodiment of the invention the throttle device 18 is in the form of parallel space elongate rectangular vanes 20 adapted to be rotated in unison about parallel axes. The vanes can rotate between a first horizontal position in which they coalesce into a single plane which substantially shuts off the cryopanels 8 and 10 from the chamber and a second vertical position in which they present a minimal impedence to gas flow and pumping. The valves may be rotated to any intermediate position to produce any selected impedance to gas flow.

The vanes 20 are mounted upon a frame 22 which leaves an annular space between the device and the enclosure 4, to permit a relatively lower pumping rate to be achieved with the valve 18 in the fully throttled position and with ion sputtering in progress.

In order to prevent water vapour together with gas and other molecules condensing upon the valve 18 and in particular upon the vanes 20 and their pivotal mountings and associated operating linkages, the valve is, according to one aspect of the present invention, secured to the enclosure 4 by a supporting spider of high thermal conductivity. The spider which consists of a plurality of radially space metal struts 24 is effective to maintain the vanes 20 as near ambient temperature as possibly by conducting heat from the enclosure 4 to compensate for heat loss to the low temperature louvres 12.

In order to maintain an acceptably high water vapour condensation rate at the cryopump whilst the throttle valve 18 is substantially shut, the cryopanel 8 is extended beyond the louvres 12 to project axially beyond valve 18 to a position substantially flush with the plane of the opening in enclosure 4. Water vapour produced in the chamber durin the sputtering and the like will accordingly selectively condense upon the extended surfaces of cryopanel 8. In this arrangement the throttle valve 18 accordingly remains relatively free from condensed water vapour and other deposits, thereby maintaining the pumping efficiency of the throttling louvres and cryogenerator pump.

It will be appreciated that while the present invention has been described with reference to a vane type throttling device it may equally be applied to throttling devices of other known forms. It will equally be appreciated that while the throttling device has been described as being maintained at ambient temperature by a low thermal conductivity support to the cryopump enclosure, other methods for maintaining the device at substantially ambient temperature, e.g., by a support of low thermal conductivity to the cryopanels may equally be employed.

We claim:

1. A crytogenerator pumping system comprising at least two cryopanels, maintained within an enclosure having an open end which is adapted for attachment to the chamber to be pumped and which embodies a throttling device spaced from the enclosure by a path of high thermal conductivity and effective to restrict the flow of gas from the chamber to the cryogenerator pump, a relatively higher temperature cryopanel within the enclosure being arranged to project beyond the plane of the throttling device whereby to be capable of condensing water and other volatile vapors produced in the chamber and thereby prevent the deposition of such vapors upon the throttling device.

2. A cryogenerator pumping system as claimed in claim 1, wherein a lower temperature cryopanel is nested within a higher temperature cryopanel spaced from the enclosure.

3. A cryogenerator pumping system as claimed in claim 2, wherein the higher temperature cryopanel immediately adjacent the enclosure extends beyond the throttling device.

4. A cryogenerator pumping system as claimed in claim 3, wherein the higher temperature cryopanel extends substantially to the opening in the enclosure communcating with the chamber to be pumped.

5. A cryogenerator pumping system as claimed in claim 4, wherein the higher temperature cryopanel and the enclosure are of substantially cylindrical form.

6. A cryogenerator pumping system as claimed in claim 5, wherein the throttling device is mounted on the enclosure by a support of high thermal conductivity.

7. A cryogenerator pumping system as claimed in claim 6, wherein the throttling device is supported by a spider mounted on the enclosure.

8. A cryogenerator pumping system as claimed in claim 8, wherein the throttling device comprises spaced parallel elongate vanes adapted to rotate in unison about parallel axes.

9. A cryogenerator pumping system as claimed in claim 8, wherein the vanes are substantially rectangular.

10. A cryogenerator pumping system as claimed in claim 9, wherein the throttling device is disposed between the opening in the enclosure communicating with the chamber to be pumped and a plurality of throttling louvres.

11. A cryogenerator pumping system as claimed in claim 10, wherein the throttling louvres are cooled by a higher temperature cryopanel.

12. A cryogenerator pumping system as claimed in claim 11, wherein the throttling louvres are in direct thermal contact with the higher temperture cryopanel.

13. A cryogeneration pumping system as claimed in claim 1 wherein the throttling device is adjustable to vary the gas flow restriction.

14. A vacuum system embodying a cryogenerator pumping system as claimed in claim 1.

* * * * *